US009309720B2

(12) United States Patent
Baugher et al.

(10) Patent No.: US 9,309,720 B2
(45) Date of Patent: Apr. 12, 2016

(54) DOUBLE SHAFT DRILLING APPARATUS WITH HANGER BEARINGS

(71) Applicant: Scientific Drilling International, Inc., Houston, TX (US)

(72) Inventors: Douglas Baugher, Houston, TX (US); Mark Chustz, Porter, TX (US); Joe Rivas, Houston, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 552 days.

(21) Appl. No.: 13/672,932

(22) Filed: Nov. 9, 2012

(65) Prior Publication Data

US 2014/0131105 A1 May 15, 2014

(51) Int. Cl.

| | |
|---|---|
| ***E21B 7/06*** | (2006.01) |
| ***E21B 4/00*** | (2006.01) |
| ***E21B 4/02*** | (2006.01) |
| ***E21B 17/03*** | (2006.01) |

(52) U.S. Cl.
CPC . *E21B 4/003* (2013.01); *E21B 4/02* (2013.01); *E21B 17/03* (2013.01)

(58) Field of Classification Search
CPC ..... E21B 17/03; E21B 47/01; E21B 47/011; E21B 47/0006; F16D 3/04
See application file for complete search history.

(56) References Cited

U.S. PATENT DOCUMENTS

| | | | | |
|---|---|---|---|---|
| 3,879,094 | A | | 4/1975 | Tschirky et al. |
| 4,263,788 | A | * | 4/1981 | Beimgraben ..... 464/147 |
| 4,303,135 | A | * | 12/1981 | Benoit ..... 175/73 |
| 4,669,555 | A | | 6/1987 | Petree |
| 4,788,544 | A | * | 11/1988 | Howard ..... 340/853.7 |
| 5,817,937 | A | | 10/1998 | Beshoory et al. |
| 6,155,345 | A | * | 12/2000 | Lee et al. ..... 166/105.5 |
| 7,518,528 | B2 | | 4/2009 | Price et al. |
| 8,069,716 | B2 | | 12/2011 | Panahi |

OTHER PUBLICATIONS

International Search Report issued in PCT/US2013/066556, dated Mar. 27, 2014, 9 pages.

* cited by examiner

*Primary Examiner* — Cathleen Hutchins
*Assistant Examiner* — Ronald Runyan
(74) *Attorney, Agent, or Firm* — Adolph Locklar

(57) ABSTRACT

A drilling apparatus includes a housing that defines a longitudinal axis. A power section of the apparatus includes rotor adapted to move with eccentric rotary motion with respect to the longitudinal axis in response to the passage of drilling fluids through the power section. A power transmission shaft has an upper end coupled to the rotor and movable with the eccentric motion of the rotor, and a lower end constrained to rotate in a concentric manner with respect to the longitudinal axis. A generally rigid torsion rod has upper and lower ends constrained to rotate in a concentric manner, and the upper end of the torsion rod is coupled to the lower end of the power transmission shaft. A mandrel including a connection for a drill bit is interconnected with the lower end of the torsion rod such that a torque may be transmitted from the torsion rod to the mandrel to drive a drill bit.

17 Claims, 3 Drawing Sheets

DOUBLE SHAFT DRILLING APPARATUS WITH HANGER BEARINGS

BACKGROUND OF THE DISCLOSURE

1. Technical Field

This invention relates generally to drilling motors for drilling boreholes into the earth. In particular, an apparatus of the present disclosure relates to a drilling motor powered by transmission of a drilling fluid therethrough.

2. Description of Related Art

Often in down-hole drilling operations, a down-hole drilling motor is suspended from the lower end of a string of drill pipe. A drilling fluid may be transmitted through the drill string and circulated or passed through the drilling motor to induce rotation of a drill bit. The rotating drill bit engages a subterranean formation to produce a borehole therein. In the drilling environment, the space available for equipment is limited at least in part by the size of the borehole to be drilled.

To drive the drill bit, a torque must often be transmitted from a power section of the motor that is remotely disposed with respect to the drill bit. In some instances, the torque must be transmitted past equipment that occupies a portion of the available space. Thus, the drive components, i.e., the mechanisms employed to transmit the torque, must often operate with a degree of axial misalignment between the drive components. Also, the drive components often operate in a harsh environment since the drilling fluid used to drive the motor may be passed through the space occupied by the drive components. The flow of the drilling fluid may tend to erode or "wash out" some of the drive components, and in some instances, the tendency to wash out the drive components may be exacerbated by a tortuous fluid flow path defined by the drive components. Accordingly, to accommodate the limited space and the harsh environment, consideration must be taken in the design of a down-hole drilling apparatus.

SUMMARY OF THE DISCLOSURE

In one embodiment of the present disclosure, a drilling apparatus includes a housing defining a longitudinal axis. A power section of the apparatus includes a rotor adapted to move with eccentric rotary motion with respect to the longitudinal axis in response to the passage of drilling fluids through the power section. A power transmission shaft is provided having an upper end and a lower end. The upper end of the power transmission shaft is coupled to the rotor such that the upper end of the power transmission shaft is movable with the eccentric motion of the rotor. The lower end of the power transmission shaft is constrained to rotate in a concentric manner with respect to the longitudinal axis. A generally rigid torsion rod has an upper end and a lower end. The upper and lower ends of the torsion rod are constrained to rotate in a concentric manner with respect to the longitudinal axis, and the upper end of the torsion rod is coupled to the lower end of the power transmission shaft such that a torque may be transmitted from the power transmission shaft to the torsion rod. A mandrel is interconnected with the lower end of the torsion rod such that a torque may be transmitted from the torsion rod to the mandrel, the mandrel including a connection for a drill bit.

According to another embodiment of the present disclosure, a drilling apparatus includes a housing defining a longitudinal axis and a nominal internal diameter. The housing includes a relatively narrow section that exhibits a limited internal diameter that is less than the nominal internal diameter. A payload bay disposed adjacent relatively narrow section of the housing, and a torsion rod is disposed in the relatively narrow section of the housing. The torsion rod is supported to rotate concentrically about the longitudinal axis. A power section includes a rotor, and the rotor is adapted to move with eccentric rotary motion with respect to the longitudinal axis in response to the passage of drilling fluids through the power section. A power transmission shaft is interconnected between the rotor and the torsion rod such that herein an upper end of the power transmission shaft is movable with the eccentric rotary motion of the rotor and a lower end of the power transmission shaft is movable with the concentric motion of the torsion rod. A mandrel for supporting a drill bit is coupled to and driven by the torsion rod.

According to another embodiment of the present disclosure, a method of operating a drilling apparatus comprises the steps of: (a) providing a power section including a rotor, wherein the rotor is adapted to move with eccentric rotary motion with respect to a longitudinal axis in response to the passage of drilling fluids through the power section, (b) providing a power transmission shaft having an upper end coupled to the rotor and movable with the eccentric rotary motion of the rotor and a lower end constrained to move with concentric rotary motion with respect to the longitudinal axis, (c) providing a torsion bar coupled to the lower end of the power transmission shaft and movable with the concentric rotary motion of the lower end of the power transmission shaft, (d) providing a mandrel coupled to the torsion bar, the mandrel rotatable in response to rotation of the torsion bar, and (e) passing a drilling fluid through the power section to move the rotor, thereby inducing eccentric rotary motion of the upper end of the power transmission shaft, concentric rotary motion of the lower end of the power transmission shaft, concentric rotary motion of the torsion bar, and rotation of the mandrel.

BRIEF DESCRIPTION OF THE DRAWINGS

The present disclosure is best understood from the following detailed description when read with the accompanying figures. In accordance with the standard practice in the industry, various features may not be drawn to scale.

DESCRIPTION OF EMBODIMENTS

It is to be understood that the following disclosure provides many different embodiments, or examples, for implementing different features of various embodiments. Specific examples of components and arrangements are described below to simplify the present disclosure. These are, of course, merely examples and are not intended to be limiting.

Figure 1:
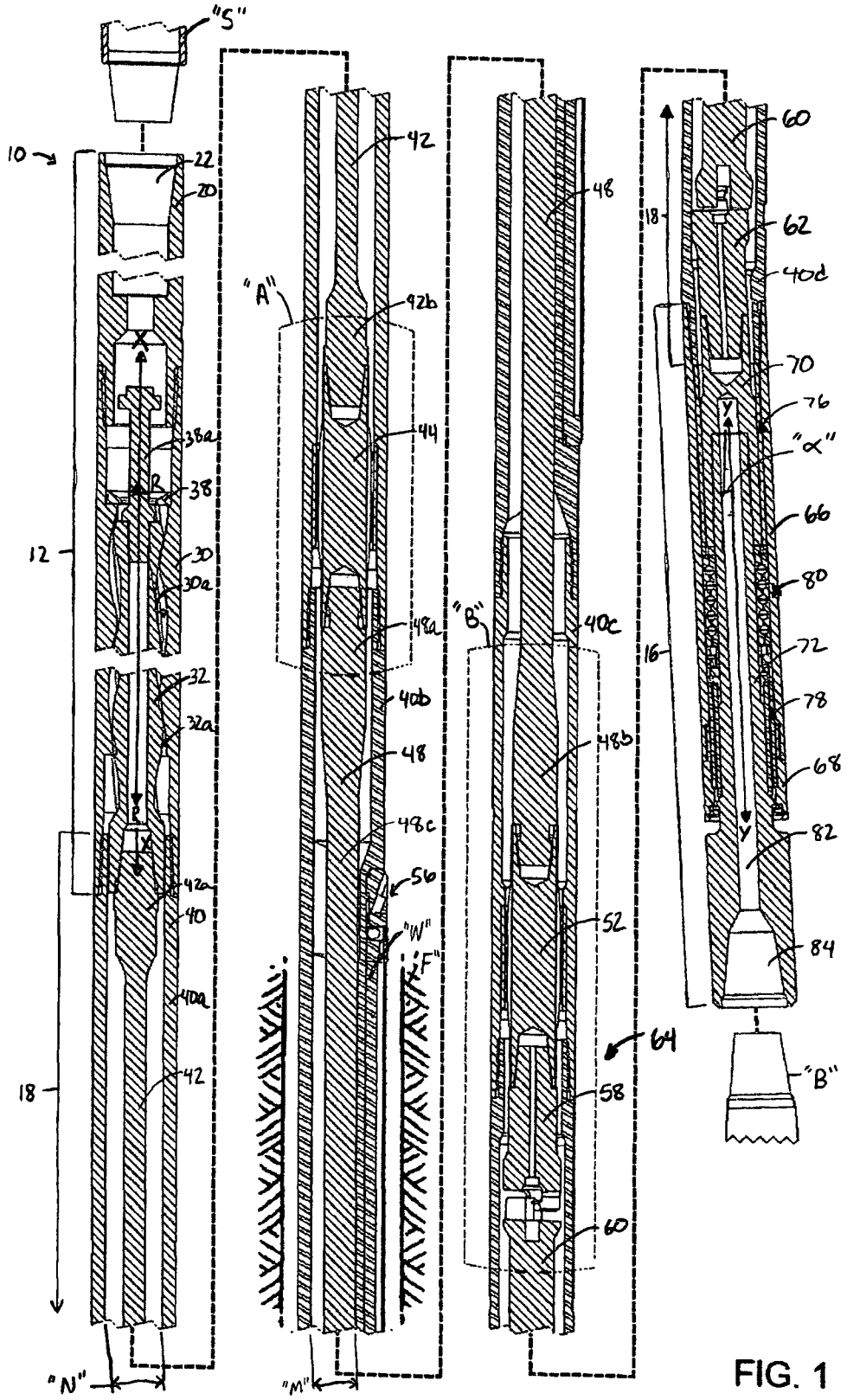
FIG. 1 is cross-sectional side view of a drilling apparatus, which includes a power section, a bearing section, and a transmission section therebetween in accordance with one or more aspects of the present disclosure.

FIG. 1 depicts a longitudinal cross-section of a drilling apparatus 10 of the present disclosure. The apparatus 10 generally includes a power section 12 at an upper end thereof, a bearing section 16 at a lower end, and a transmission section 18 therebetween. As used herein, the term "upper" refers to a direction or side of a component that is oriented toward the surface of a borehole, while the term "lower refers" to the direction or side of a component oriented toward the portion of the borehole most distant from the surface. The power section 12 is adapted to provide rotary motion to a drill bit "B," which may be coupled to a lower end of the bearing section 16. The transmission section 18 is adapted to transmit rotary motion produced in the power section 12 to the bearing section 16. The power section 12 defines a central longitudinal axis X-X, and the bearing section 16 defines an axis Y-Y that is disposed at a bend angle "α" with respect to the longitudinal axis X-X. The angle "α" may lie in the range of about 0 to about 4 degrees, and thus, the bearing section 16 may support rotary motion of drill bit "B" at an oblique angle with respect to the power section 12.

The power section 12 includes a top subassembly or top sub 20 at an upper end thereof. The top sub 20 has a threaded tubular connection 22 at its upper end, for coupling the apparatus 10 to a drill string "S" disposed above the apparatus 10. The drill string "S" may include multiple sections of drill pipe and/or drill collars interconnected with one another in an end to end manner, and may thus interconnect the apparatus 10 to equipment at the surface of a borehole.

The power section 12 further includes a stator 30 fixedly supported by a lower end of the top sub 20. The stator 30 defines a helically contoured inner surface 30*a*, which circumscribes a rotor 32. The rotor 32 defines a helically contoured outer surface 32*a*, which is configured to engage the helically contoured inner surface 30*a* of the stator 30 inner surface to guide motion of the rotor. The stator 30 and rotor 32 together may comprise a "Moineau," or positive displacement type motor that is operated by the passage of drilling fluids (or mud) therethrough. A drilling fluid may be pumped down through the drill string "S" and through the stator 30 to induce the rotor 32 to simultaneously rotate about an axis R-R defined through the rotor 32 and orbit or roll around the inner surface 30*a* of the stator 30. Depending in part on the particular geometry of the contoured surfaces 30*a*, 32*a*, the orbital motion of the rotor 32 may be generally circular, elliptical, polygonal or may follow an alternate path. The rotary motion of the rotor 32 may be generally characterized as eccentric motion with respect to the longitudinal axis X-X since components of the rotary motion may not be aligned with the axis X-X.

A rotor catch rod 36 is coupled to an upper end of the rotor 32 such that the rotor catch rod nominally moves with the eccentric motion of the rotor 32. The rotor catch rod 36 extends through a rotor catch ring 38, which is secured to the stator 30 and provides clearance for the nominal movement of a relatively narrow portion 36*a* of the rotor catch rod 36. However, in the event of a breakage or failure within the apparatus 10 that permits the rotor 32 to fall with respect to the stator 30, the rotor catch ring 38 will generate an interference with a relatively broad portion 36*b* of the rotor catch rod 36. Thus, the rotor catch rod 36 together with the rotor catch ring 38 serve to "catch" or interrupt the falling of the rotor 32 and any of the components connected thereto.

Below the power section 12 the transmission section includes an outer housing 40 coupled to the stator 30 such that the outer housing remains relatively stationary with respect to the stator 30 and top sub 20. The outer housing 40 may include multiple sections 40*a*, 40*b*, 40*c* and 40*d* along its length, which are coupled to one another by a threaded or similar connection in alignment with the longitudinal axis X-X. The outer housing section 40*a* defines a nominal internal diameter designated "N."

A power transmission shaft includes flexible shaft 42, and is disposed within the outer housing section 40*a*. The flexible shaft 42 is constructed of a conformable material that is capable of transmitting a torque therethrough. An upper end 42*a* of the flexible shaft 42 is coupled to the rotor 32 and receives eccentric rotary motion therefrom. A lower end 42*b* of the flexible shaft 42 is coupled to a first or upper hanger bearing 44, which serves to constrain the rotation of the lower end 42*b* of the flexible shaft in a concentric manner, e.g., constrains the movement to rotation about the longitudinal axis X-X. Thus, the conformable nature of the flexible shaft 42 permits the flexible shaft 42 to serve as a transmission that converts the eccentric motion of rotor 32 to concentric motion. The power transmission shaft may include other mechanisms to accommodate the conversion of eccentric motion to concentric motion. For example, the power transmission shaft may include a universal joint, or a constant-velocity joint (CV joint) configured to transmit torque at a constant rotational speed through a variable angle. Many CV joints include a pair of circumferential flanges with roller bearings disposed therebetween to accommodate the variable angle. The power transmission shaft may also include a knuckle joint 64 as described below.

An upper end 48*a* of a torsion rod 48 is coupled to the hanger bearing 44 opposite the flexible shaft 42 such that concentric movement of the hanger bearing 44 may be transmitted to the torsion rod 48. The torsion rod 48 may be considered to "hang" from the hanger bearing 44. A lower end 48*b* of the torsion rod 48 is coupled to a second or lower hanger bearing 52, which constrains rotation of the lower end 48*b* of the torsion rod 48 in a concentric manner. The torsion rod 48 may be constructed of a substantially rigid material such as steel, and may exhibit a relatively narrow midsection 48*c*. The narrow midsection 48*c* is generally adjacent and parallel to a payload bay 56 disposed on the outer housing section 40*b*. The payload bay 56 may carry equipment to facilitate a drilling operation such as a sensor and data transmission assembly "W" for use in a measure-while-drilling (MWD) or logging-while-drilling (LWD) system. An MWD or LWD system may provide the capability to transmit signals representative of a drilling condition into a nearby rock formation "F" and to the surface. A more detailed description of an MWD or LWD may be found in commonly owned U.S. Pat. Nos. 7,518,528 and 8,069,716, each of which are incorporated herein by reference in their entirety.

The payload bay 56 occupies a portion of the radial space provided by the outer housing section 40*b*, and thus, a limited or minimum internal diameter "M" is defined adjacent the payload bay 56. The minimum internal diameter "M" limits the size, and thus the robustness, of the relatively narrow midsection 48*c* of the torsion bar 48.

A first drive coupling or adapter 58 is coupled to the lower hanger bearing 52 opposite the torsion rod 48. The adapter 58 transmits torque to a first driven rod 60, which is coupled to and transmits torque a second drive coupling or adapter 62. Together, the driven rod 60 and the adapters 58, 62 define a knuckle joint 64 and permit the apparatus 10 to transmit torque through the angle "α" to the bearing section 16. The adapters 58, 62 may comprise, e.g., knuckle couplings capable of accommodating up to a 6° bend, or alternatively, the driven rod 60 may comprise a flexible shaft or coupling. It is contemplated that adapters 58, 62, driven rod 60 other drive transmission components described herein, e.g., flexible shaft 42, hanger bearings 44, 52 and torsion rod 48, may be attached by known latching mechanisms such as a combination of pins and set screws. Other methods of attachment will be apparent to those of ordinary skill in the art.

The bearing section 16 generally includes a bearing housing 66 coupled to the outer housing section 40*d* at the angle "α" relative to the longitudinal axis X-X. An end nut 68 is coupled to bearing housing 66 defines a lower-most housing component for the drilling apparatus 10. A flow diverter 70 and mandrel 72 are disposed within the bearing housing 66 and are rotatable about the axis Y-Y. The flow diverter 70 is coupled to the second adapter 62 such that torque may be transmitted from the second adapter 62 to the flow diverter 70. Similarly the mandrel 72 is coupled to the flow diverter 70 such that torque may be transmitted from the flow diverter 70 to the mandrel 72. Rotation of the flow diverter 70 and mandrel 72 is supported by upper and lower radial bearings 76, 78, and by a thrust bearing package 80 disposed axially therebetween. The radial bearings 76 and 78 accommodate radial loads experienced by the drill bit "B", and may comprise at least one annular member defining a circumferential bearing surface. The radial bearings 76 and 78 may be constructed, e.g., from cemented tungsten carbide, or a suitable ceramic, metal, or other bearing material. The thrust bearing package 80 is provided primarily to accommodate vertical or longitudinal loads, e.g., loads directed along axis Y-Y, and may comprise ball bearings movable through annular races, polycrystalline diamond compact (PDC) bearings, or other suitable arrangements as known in the art.

The mandrel 72 provides a threaded connection 84 for engaging the drill bit "B" such that torque and rotary motion may be transmitted from the mandrel 72 to the drill bit "B." Thus, in operation, the drill bit "B" is operatively coupled to the rotor 32 to receive torque and rotary motion therefrom. The torque and rotary motion transmitted from the rotor 32 through the flexible shaft 42, upper hanger bearing 44, torsion bar 48, lower hanger bearing 52, adapter 58, driven rod 60, adapter 62, flow diverter 70 and mandrel 72 to drive the drill bit "B."

Drilling fluid that is pumped through the drill string "S" to drive the rotor 32 flows through the power section 12 into the transmission section 18 where it flows generally in the annular space between the outer housing 40 and the drive components, which include the flexible shaft 42, upper hanger bearing 44, torsion rod 48, lower hanger bearing 52, adapter 58, driven rod 60 and adapter 62 Upon entering the bearing section 16, the flow diverter 70 operates to divert a portion of the drilling fluid exiting the transmission section 18 into a passage of the 82 of the drilling mandrel 72. Another portion of the drilling fluid may flow in annular space between the bearing housing 66 and the mandrel 72 and may serve to lubricate the bearings 76, 78 and 80. Drilling fluid that passes through the passage 82 may flow through the drill bit "B" into the borehole, and may be recirculated through the annular space between the apparatus 10 and the formation "F."

In other embodiments (not shown), the knuckle joint 64 may be replaced with alternate flexible couplings known in the art. For example, a CV joint, universal joint, flexible shaft, or similar mechanism may be employed to accommodate the oblique angle "α" of the mandrel 72 with respect to the longitudinal axis X-X.

Figure 2:
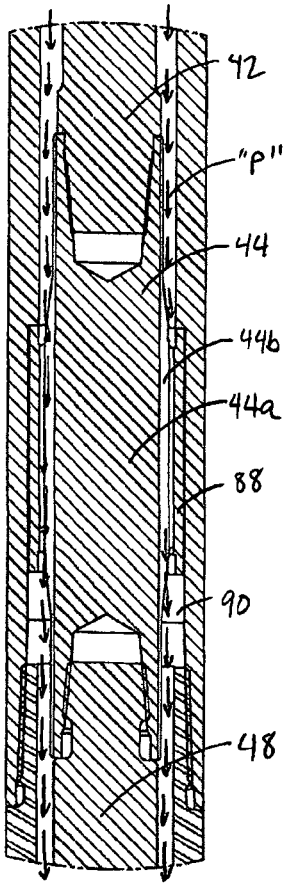
FIG. 2 is an enlarged view of the area of interest "A" identified FIG. 1, which depicts an upper hanger bearing.

Referring now to FIG. 2, the upper hanger bearing 44, and a drilling fluid flow path around flexible shaft 42, upper in the vicinity of the upper hanger bearing 44 is depicted. The hanger bearing 44 includes a generally solid body 44*a* and a plurality of fins 44*b* that project radially therefrom. The fins 44*b* define an annular array and engage a generally cylindrical outer radial bearing 88. A fluid flow path is defined in the voids between the fins 44*b*, the body 44*a* and the outer radial bearing 88 as indicated by arrows "P." The fluid flow path is maintained generally in an annular space as it passes the flexible shaft 42, hanger bearing 44 and torsion rod 48. By maintaining an annular flow path around the solid body 44*a* of the hanger bearing 44, rather than directing fluid through a passageway (not shown) through the hanger bearing 44, e.g., the degree of erosion of the hanger bearing 44 by the drilling fluid may be limited.

The outer radial bearing 88 may be rotationally fixed by spacers 90 disposed longitudinally between the outer radial bearing 88 and the outer housing section 40*c*. The spacers 90 may form an interferences fit, or may be held in compression by the end nut 68 (FIG. 1).

Figure 3:
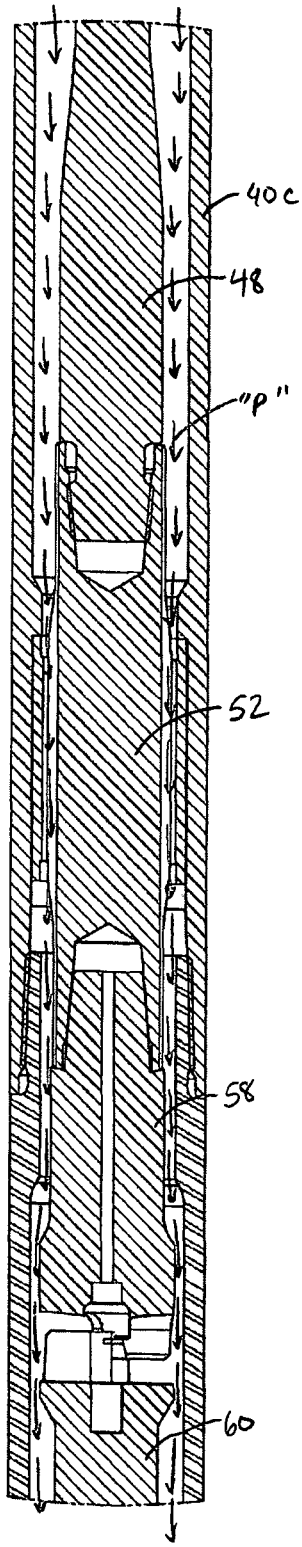
FIG. 3 is an enlarged view of the area of interest "B" identified FIG. 1, which depicts a lower hanger bearing.

Referring now to FIG. 3, a similar flow path is established in the vicinity of lower hanger bearing 52. The fluid flow path, denoted by arrows "P," is maintained generally in the annular space between the torsion rod 48 and the outer housing section 40*b*. The drilling fluid may then pass the lower hanger bearing 52 in an array of voids defined between hanger bearing body 52*a*, radially extending fins 52*b* and an outer radial bearing 92. The drilling fluid maintains a generally annular flow path as it flows past the adapter 58 and driven rod 60.

Figure 4A:
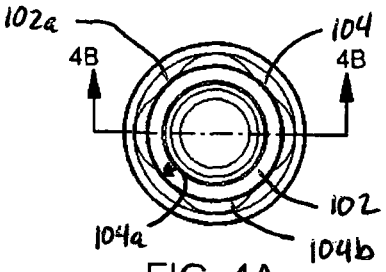
FIGS. 4A and 4B are respectively front and cross sectional side views of an alternate embodiment of a hanger bearing in accordance with one or more aspects of the present disclosure depicting an annular drilling fluid flow path around the hanger bearing.
Figure 4B:
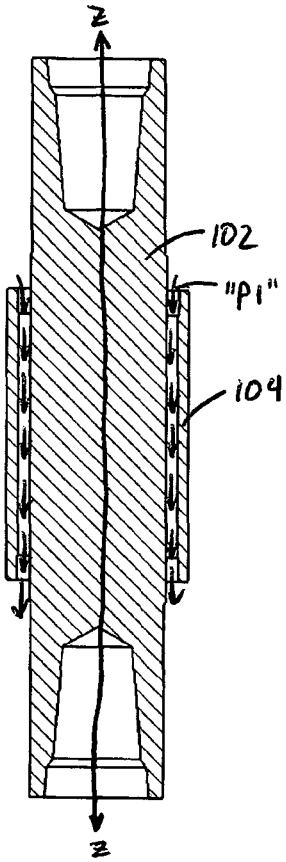

Referring now to FIGS. 4A and 4B, an alternate configuration of a hanger bearing 102 and outer radial bearing 104 is depicted. The hanger bearing 102 defines a generally cylindrical or circular outer circumferential surface 102*a*. The circumferential surface 102*a* defines a bearing surface that engages an inner circumferential surface 104*a* of the outer radial bearing 104. The inner circumferential surface 104*a* is interrupted by longitudinal grooves 104*b* formed in the outer radial bearing 104. The longitudinal grooves 104*b* provide a fluid flow path for drilling fluids as indicated by arrows "P1." The longitudinal grooves 104*b* may remain relatively stationary relative to rotational motion of the hanger bearing 102 about a central axis Z-Z.

Figure 5:
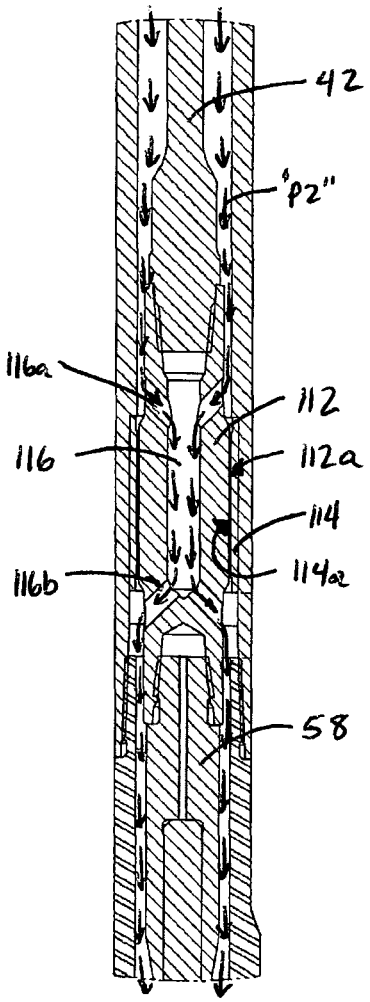
FIG. 5 is a cross-sectional side view of an alternate embodiment of a hanger bearing through which an interior drilling fluid flow path is defined.

Referring now to FIG. 5, another alternate configuration of a hanger bearing 112 and outer radial bearing 114 is depicted. The hanger bearing 112 defines a generally cylindrical or circular outer circumferential surface 112*a*, which defines a bearing surface that engages generally circular inner circumferential surface 114*a* defined by the outer radial bearing 114. The outer and inner circumferential surfaces 112*a* and 114*a* are both generally continuous, and thus, only a relatively small portion of the drilling fluid is permitted to pass between the outer and inner circumferential surfaces 112*a* and 114*a*, e.g. to lubricate the bearing surfaces 112*a* and 114*a*. An interior passageway 116 is defined through the hanger bearing 112 and defines a drilling fluid flow path therethrough as indicated by arrows "P2." The fluid flow path indicated by arrows "P2" is generally annularly shaped about an upper drive component such as power transmission shaft 42 and about a lower drive component such as adapter 58. An inlet 116*a* transitions the annular shape of the fluid flow path around the power transmission shaft 42 to the shape of the interior passageway 116. An outlet 116*b* transitions the shape of the interior passageway to the annular shape around the adapter 58. Although the hanger bearing 112 is depicted as connecting the power transmission shaft 42 and adapter 58, the hanger bearing 112 may be provided between any of the drive components discussed above and the hanger bearing 112 may be incorporated in place of any of the hanger bearings 44, 52, 102 discussed above.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. A drilling apparatus comprising:

a housing defining a longitudinal axis;

a power section including a rotor, wherein the rotor is adapted to move with eccentric rotary motion with respect to the longitudinal axis in response to the passage of drilling fluids through the power section;

a power transmission shaft having an upper end and a lower end, the upper end of the power transmission shaft coupled to the rotor such that the upper end of the power transmission shaft is movable with the eccentric motion of the rotor, and wherein the lower end of the power transmission shaft is constrained to rotate in a concentric manner with respect to the longitudinal axis;

a generally rigid torsion rod having an upper end and a lower end, wherein the upper and lower ends of the torsion rod constrained to rotate in a concentric manner with respect to the longitudinal axis, and wherein the upper end of the torsion rod is coupled to the lower end of the power transmission shaft such that a torque may be transmitted from the power transmission shaft to the torsion rod; and a mandrel interconnected with the lower end of the torsion rod by at least one flexible coupling such that the torque may be transmitted from the torsion rod to the mandrel, the mandrel disposed at an oblique angle with respect to the longitudinal axis, the mandrel including a connection for a drill bit.

2. The drilling apparatus according to claim 1, further comprising an upper hanger bearing coupled to the lower end of the power transmission shaft and the upper end of the torsion rod such that the upper hanger bearing constrains the lower end of the power transmission shaft and the upper end of the torsion rod to rotate in the concentric manner.

3. The drilling apparatus according to claim 2, further comprising a lower hanger bearing coupled to the lower end of the torsion rod such that the lower hanger bearing constrains the lower end of the torsion rod to rotate in the concentric manner.

4. The drilling apparatus according to claim 3, wherein the upper and lower hanger bearings each include a generally solid body and a plurality of fins projecting radially therefrom, and wherein voids defined between the fins define flow path for drilling fluid.

5. The drilling apparatus according to claim 2, further comprising an outer radial bearing disposed circumferentially around the upper hanger bearing such that an inner circumferential surface of the outer radial bearing engages an outer circumferential surface of the upper hanger bearing, and wherein the inner circumferential surface of the outer radial bearing includes at least one longitudinal groove formed therein to define flow path for drilling fluid.

6. The drilling apparatus according to claim 1, wherein the power transmission shaft includes at least one of a flexible shaft, CV joint and a knuckle joint.

7. The drilling apparatus according to claim 1, wherein the generally rigid torsion rod further comprises a relatively narrow midsection and the housing further comprises a payload bay disposed adjacent the relatively narrow midsection of the generally rigid torsion rod, and wherein the housing defines a minimum internal diameter adjacent the payload bay.

8. A drilling apparatus comprising:

a housing defining a longitudinal axis and a nominal internal diameter, the housing including a relatively narrow section that exhibits a limited internal diameter that is less than the nominal internal diameter;

a payload bay disposed adjacent relatively narrow section of the housing;

a torsion rod disposed in the relatively narrow section of the housing, the torsion rod supported to rotate concentrically about the longitudinal axis, the torsion rod including a relatively narrow midsection positioned in substantial alignment with the relatively narrow section of the housing;

a power section including a rotor, wherein the rotor is adapted to move with eccentric rotary motion with respect to the longitudinal axis in response to the passage of drilling fluids through the power section;

a power transmission shaft interconnected between the rotor and the torsion rod, wherein an upper end of the power transmission shaft is movable with the eccentric rotary motion of the rotor, and wherein a lower end of the power transmission shaft is movable with the concentric motion of the torsion rod; and a mandrel for supporting a drill bit coupled to and driven by the torsion rod, the mandrel coupled to the torsion rod by at least one flexible coupling, the mandrel disposed at an oblique angle with respect to the longitudinal axis.

9. The drilling apparatus according to claim 8, wherein the torsion rod is constructed of a generally solid bar.

10. The drilling apparatus according to claim 8, wherein a sensor and data transmission assembly is disposed within the payload bay.

11. The drilling apparatus according to claim 8, further comprising an upper hanger bearing interconnected between the power transmission shaft and the torsion rod, the upper hanger bearing defining an annular flow path for the passage of drilling fluids.

12. The drilling apparatus according to claim 11, further comprising a lower hanger bearing interconnected between the torsion rod and mandrel.

13. The drilling apparatus according to claim 8, further comprising a hanger bearing interconnected between the power transmission shaft and the torsion rod, the hanger bearing defining an interior flow path for the passage of drilling fluids therethrough.

14. A method of operating a drilling apparatus, the method comprising the steps of:

providing a power section including a rotor, wherein the rotor is adapted to move with eccentric rotary motion with respect to a longitudinal axis in response to the passage of drilling fluids through the power section;

providing a power transmission shaft having an upper end coupled to the rotor and movable with the eccentric rotary motion of the rotor and a lower end constrained to move with concentric rotary motion with respect to the longitudinal axis;

providing a torsion bar coupled to the lower end of the power transmission shaft and movable with the concentric rotary motion of the lower end of the power transmission shaft;

providing a mandrel coupled to the torsion bar by at least one flexible coupling, the mandrel disposed at an oblique angle with respect to the longitudinal axis, the mandrel rotatable in response to rotation of the torsion bar; and passing a drilling fluid through the power section to move the rotor, thereby inducing eccentric rotary motion of the upper end of the power transmission shaft, concentric rotary motion of the lower end of the power transmission shaft, concentric rotary motion of the torsion bar, and rotation of the mandrel.

15. The method according to claim 14, further including the step of providing an upper hanger bearing coupled to an upper end of the torsion bar and a lower hanger bearing coupled to a lower end of the torsion bar, the upper and lower hanger bearings adapted to maintain concentric rotation of the torsion bar.

16. The method according to claim 15, further comprising the step of passing the drilling fluid through an annular passageway defined by the upper and lower hanger bearings and by the torsion bar.

17. The method according to claim 14, further comprising the step of passing the drilling fluid through an interior passageway defined through at least one of the upper and lower hanger bearings.

* * * * *